United States Patent [19]

White et al.

[11] 4,030,239

[45] June 21, 1977

[54] MULTIPLE FACE DOLL

[75] Inventors: Peter Charles White, Rancho Palos Verdes; John Terry Benson, Canoga Park; Richard Anthony Leoncavallo, Anaheim, all of Calif.

[73] Assignee: Mattel, Inc., Hawthorne, Calif.

[22] Filed: Jan. 29, 1976

[21] Appl. No.: 653,551

[52] U.S. Cl. ..... 46/135 R; 46/153

[51] Int. Cl.[2] ..... A63H 13/00

[58] Field of Search ..... 46/153, 164, 135, 119, 46/118

[56] References Cited

UNITED STATES PATENTS

| | | | |
|---|---|---|---|
| 525,716 | 9/1894 | McElroy | 46/119 |
| 1,387,224 | 8/1921 | Ahler | 46/153 |
| 1,610,724 | 12/1926 | Wilson | 46/153 |
| 1,615,401 | 1/1927 | Payne | 46/153 |
| 2,584,798 | 2/1952 | Goerditz | 46/153 |

FOREIGN PATENTS OR APPLICATIONS

| | | | |
|---|---|---|---|
| 1,042,944 | 6/1953 | France | 46/120 |
| 14,429 | 7/1881 | Germany | 46/153 |
| 448,937 | 9/1927 | Germany | 46/153 |

*Primary Examiner*—F. Barry Shay
*Attorney, Agent, or Firm*—Stephen L. King; Max E. Shirk; Robert W. Mulcahy

[57] ABSTRACT

A doll with a rotatable head having oppositely positioned visible and hidden faces.

One arm of doll may be rotated to load a torsion spring biasing the hidden face to an exposed position. The hidden face is held back by a detent. A pushbutton in the back of the doll may be pushed to release the detent so that the hidden face is suddenly moved to an exposed position by the torsion spring.

17 Claims, 9 Drawing Figures

MULTIPLE FACE DOLL

FIELD OF THE INVENTION

This invention relates to multiple faced dolls and, more particularly, to an improvement in dolls in which the front view facial expression of the doll may be changed almost instantaneously by rapid spring driven 180° rotation of the doll head.

BACKGROUND OF THE INVENTION

There heretofore exist animated figurines or dolls, as variously termed, in which the viewed facial expression is changed, for example from an expression of delight to an expression of grimace, responsive to actuation of an actuating member. Typically, these types of dolls include a head, which is mounted for rotation on a shaft, with one face exposed and with the other diametrically opposite face concealed behind a positionally fixed simulated hairpiece or like supported by the shaft. By operation of the actuating mechanism the head is drivingly rotated so that the previously concealed face becomes exposed and the previously exposed face rotates into the concealed position. The types of devices in which the present application is concerned are those which involve the use of a loaded torsion spring to substantially instantaneously bring about the aforedescribed change of face. Examples of these types of animated multifaced dolls appear in the prior art patent literature of which the following have been made known to applicants and which by way of background may be of interest to the reader. These include U.S. Pat. Nos. 1,387,224; 525,716; 3,597,878; 3,538,638; 2,954,639; 3,538,638; 3,611,625; and particularly U.S. Pat No. 2,584,798. There are further related thereto and by way of further background to the present invention, appendage animating means for figure toys, such as is shown in U.S. Pat. Nos. 3,492,759; 3,699,713 and French patent 1,042,944. The appendage animating means illustrated in patent U.S. Pat. No. 3,699,713 and assigned to Mattel, Inc., assignee of the present application, is of particular interest in that is discloses and employs a manually actuated pushbutton at the rear of the torso which actuates movement of an arm. In U.S. Pat. No. 3,492,759 it is shown that one may employ a spring to return a doll's head to a front position and lower its arm after the arms have been moved by rocking a shaft by pushing upon a pushbutton located at the rear of the doll. In U.S. Pat. No. 3,597,878, assigned to the assignee of the present invention, a torsion spring couples a doll's head to its torso. The head spotting assembly associated therewith inhibits rotation of the head during a fixed preselected portion of each revolution of the doll's torso about a fixed vertical shaft until the head is released. The torsion spring then instantaneously rotates the head until it catches up with the rotating torso and follows it during the remaining revolution of the torso. And in U.S. Pat. No. 1,387,224 it is shown that a doll may be provided with two faces, one of which is hidden by a stationary wig, in which the hidden face is brought into view by pushing a button to rotate the head.

OBJECTS OF THE INVENTION

The present invention has an object, providing a novel head-rotating structure in a multiple faced doll for rotating the head which is of inexpensive and compact construction.

A further object of the invention is to provide a multifaced doll containing a spring-loaded mechanism in which the mechanism may be energized by rotating an appendage of the doll through 180° or less and in which the faces may be thereafter changed through operation of a pushbutton or other torso portion located at the rear of the doll.

BRIEF SUMMARY

Briefly, the invention includes a doll torso containing a shaft which fixedly supports a wig, a head-supporting sleeve or head sleeve member located on said shaft for rotation thereabout supporting a head containing two faces, diametrically opposite one another, and having a normal position in which one of the faces is exposed and the other of the two faces is concealed behind the supported wig. A spring mechanism, containing a helical torsion spring means is located on the shaft. Means associated with one of the rotatably mounted arms is responsive to rotation of the arm to further load or cock the spring mechanism. Additionally, means having a pushbotton member located at the rear of the torso is included within the torso and responsive to actuation of the push member releases the spring mechanism, which thereupon rotates the sleeve carrying the head through 180° whereby the alternate face is exposed to view.

In a more detailed aspect of the invention, the head-driving spring mechanism includes a cam gear assembly rotatably and slidably mounted on the shaft at a location thereof underlying the head sleeve member. The cam gear assembly includes a toothed gear surface about is periphery and an axially projecting cam member having a straight surface directed toward the neck sleeve. A helical torsion spring is mounted about the shaft and has its upper end coupled to the sleeve member and its lower end coupled to the gear assembly for urging the latter two in counter-rotation about the shaft. Additionally, a detent member is formed integral with the sleeve member and has a flat surface and which extends axially beneath the main body of the sleeve carried by a flexible strip. A pair of stops are formed integral with the wall in the neck portion of the torso located approximatlely 180° apart. The neck sleeve and the cam gear assembly are mounted so that after 180° revolution of the neck sleeve, the detent abuts against one of the stops to prevent further rotation of the neck sleeve. Additionally, the protruding cam member of the gear assembly is mounted so that during its revolution it abuts against the detent carried by the neck sleeve to stop futher rotation of the cam gear assembly. The means responsive to mechanical actuation at the rear of the torso for releasing the spring mechanism incudes means to slide the cam gear assembly upwarly axially along the shaft to engage the protruding cam and the flexible strip carrying the detent for pushing the detent off of the stop, whereupon the neck sleeve is driven by the torsion spring rapidly one-half revolution until the carried detent abuts the diametrically oppositely located stop.

In a still further aspect of the invention a rotatably mounted arm is coupled by means of a ratchet and stop pawl mechanism to a gear wheel located within the torso. The gear engages the aforesaid gear of the gear cam assembly. By rotating the arm in one direction the ratchet releases, allowing the arm to move. Moving the arm in the other direction rotates the gear associated therewith and in turn rotates the gear of the cam gear assembly and further winds the torsion spring. In the rotation of the cam gear assembly as previously described, the gear rotates only 180° until the protruding cam abuts the detent of the neck sleeve assembly and further rotation of the arm is of no effect other than to unclutch the arm from the ratchet gear assembly.

The foreging and other objects and advantages of the present invention, together with the structure characteristic of the invention, is better understood by giving consideration to the detailed description of a preferred embodiment of the invention which follows taken together with the figures of the drawing illustrative of the invention.

DETAILED DESCRIPTION

Figure 1A:
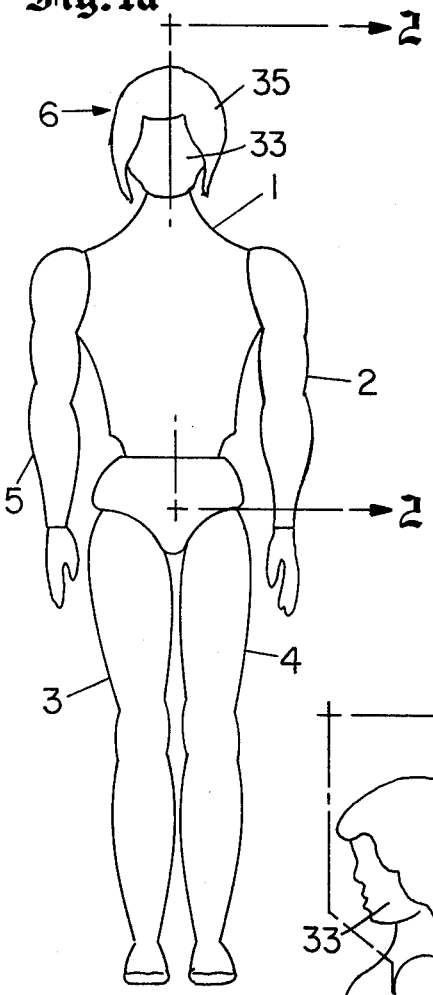
FIG. 1*a* and FIG. 1*b* illustrate the outline of the doll of the invention drawn to reduced scale.
Figure 1B:
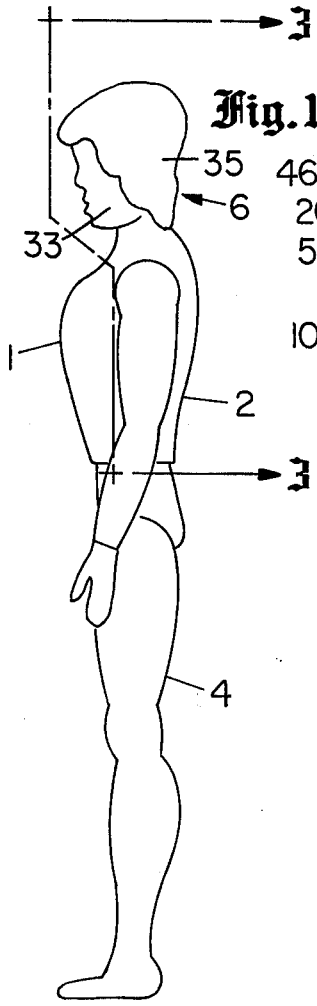

FIG. 1*a* outlines a preferred embodiment of the invention in front perspective and FIG. 1*b* illustrates a preferred embodiment of the invention in side persepective and drawn to reduced scale. The doll incudes a torso 1 having a neck portion, a right arm 5, a left arm 2, a right leg 3 and left leg 4, a head assembly 6 having an exposed face 33 and a wig or simulated hair piece 35 as well as hands and feet and a pelvic portion. As is conventional, the legs contain movable joints and the right arm is rotatably mounted using the conventional structure of prior art poseable dolls, such as the models of animated dolls previously sold by Mattel, Inc., assignee of this application, under the trademark "Big Jim", and as illustrated in U.S. Pat. No. 3,699.713. Inasmuch as those details do not contribute to the understanding of the invention, they are not further described or discussed and the reader is referred to the prior art. FIGS. 1*a* and 1*b* serve as background for the succeeding figures and provide context for the somewhat complex internal mechanisms and their mounting used in the doll. Thus a particulr cross-section is taken along the section line 2—2 in FIG. 1*a* and as hereafter appears as FIG. 2. FIG. 3 comprises the sections of FIG. 1*b* taken along the circuitous section line 3—3 in FIG. 1*b*.

Figure 2:
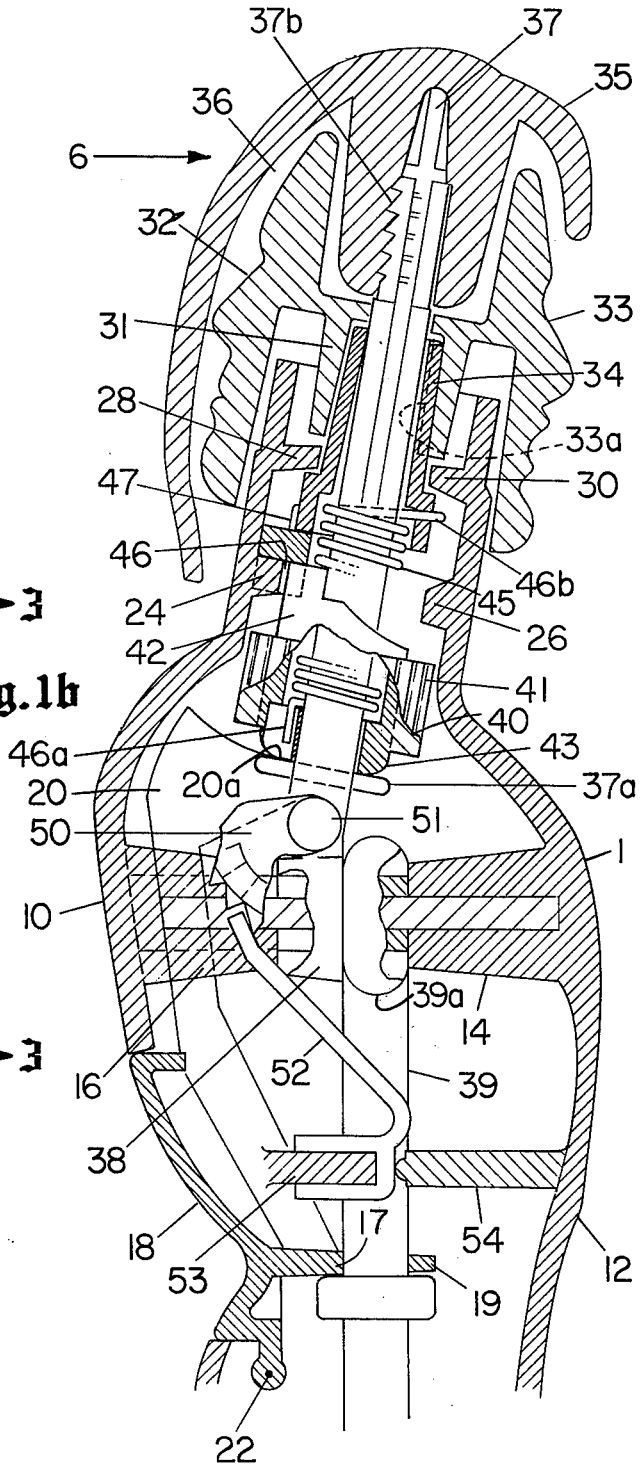
FIG. 2 is a cross-section of the doll taken along the line 2—2 of FIG. 1*a*.
Figure 3:
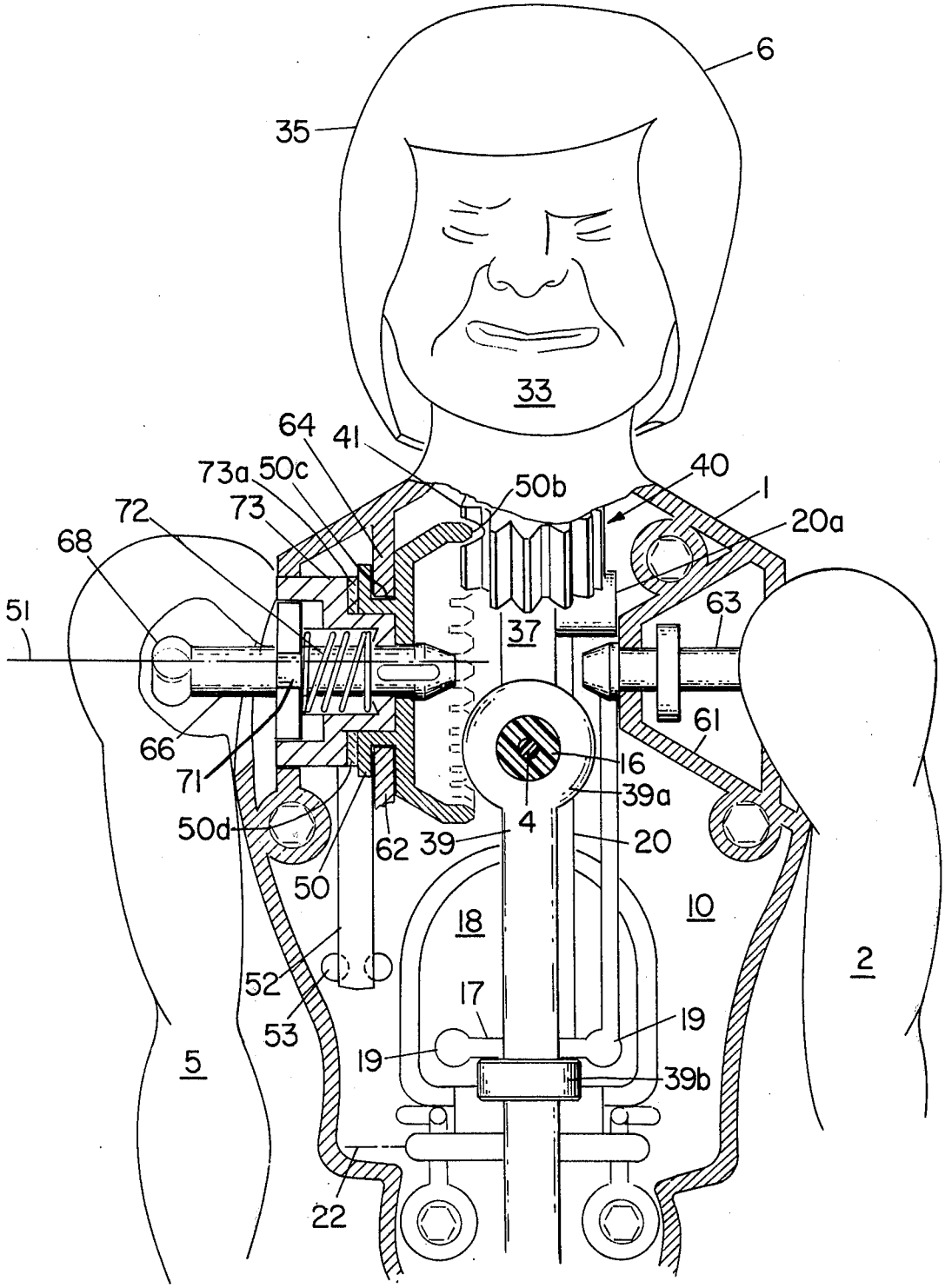
FIG. 3 is a corss-section of the doll taken along line 3—3 FIG. 1*b*.

The torso portion as viewed in FIG. 2 includes a back portion 10 and a front portion 12. The portions are held together by a plurality of pins, most of which are not illustrated in this figure, and by two projecting members 14 and 16 which fit together as shown. Flush with the back of the torso is the exposed portion of a pushbutton 18. The pushbotton carries a lever portion 20 having a ramp or wedge shaped upper surface 20*a* (FIG. 4) within the torso and is pivotally mounted for pivoting about an axis 22 by means of supports not illustrated in this figure. The upwardly extending neck portion of each torso half 10 and 12 includes integrally formed stop 24 and stop 26, respectively, located 180° apart, the details of which are made more apparent hereinafter. Additionally, annular end portions 28 and 30 of torso halves 10 and 12, respectively, form an inwardly turned rim or retaining wall for other elements as hereinafter explained.

The head assembly 6 includes a head member 31 first face 32, which has a grim expression, and a second face 33, which has a smiling expression, located diametrically opposite to one another and shown in section in this figure. An axially extending passage extends through the head member 31. The head 31 is mounted to a sleevelike member or neck sleeve 34, as variously termed, for rotation therewith. The simulated haripiece 35 is mounted to an end of a shaft 37, extending through the passage in head 31, and contains a hollowed out region 36 concealing face 32. Suitably the shaft 37 contains a series of spike teeth 37*b* so as to serve to fixedly retain the hairpiece in proper place atop the shaft.

A projecting axially extending ridge 33*a* on the back of face 33 engages an axially extending groove 34*a* (FIG. 4) opening along neck sleeve 34 to interlock the head and the neck sleeve for joint rotational movement.

At its lowermost end shaft 37 includes a bracket or eyelet 38 having an opening into which is received the mounting members 14 and 16 of the torso halves so as to fixedly mount the shaft to the torso. An elastic thong member 39 having an eyelet end 39*a* is also mounted by means of the eyelet end illustrated partially in section between the members 14 and 16. At its other end the thong 39 is coupled to a lower portion of the torso not illustrated in this figure.

A ratchet wheel 50 rotatable about an axis 51 and cooperating with a stop pawl 52 is partially illustrated in this figure. This is a conventional type of mechanism in which rotation of the ratchet in one direction forces the pawl out of engagement with the ratchet teeth, and in which the pawl prevents counter-rotation of the ratchet. Stop pawl 52 is mounted on an extending bracket 53 which is integral with and extends from the torso half 10 and is there held in place in a clamplike arrangement by a second bracket 54 which is integral with and extends from torso half 12. The significance and further description of elements 50 through 54 is discussed hereinafter in connection with the other figures.

A cam gear assembly 40 shown partially in section contains a gear having a gear teeth 41 extending about the periphery, an axially protruding cam portion 42, and a surface portion 43. The cam gear assembly is rotatably and slidably mounted on shaft 37 as illustrated. Portion 42 is located off the axis of rotation and includes a straight flat portion as shown. A torsion spring 45, which is of conventional helix geometry, is mounted about shaft 37. The spring has its lowermost end 46*a* coupled to cam gear 40 and has its other end 46*b* hooked onto a portion of neck sleeve 34.

Shaft 37 includes a stop member 37*a* to prevent the cam gear assembly from axially sliding further down shaft 37. A detent 46 (FIGS. 2, 4 and 5) is carried by a flexible strip 47, partially shown, integrally formed in and axially depending from the main body portion of the neck sleeve assembly. It is seen that the detent 46 is mounted so that during rotation of sleeve 34, the stops 24, 26 are in the path of movement of the detent. Further protruding cam portion 42 is mounted so that during the rotation of the gear 41, the path of the cam encounters the detent 46, but not stops 24 or 26. The geometry of the detent is that it extends radially inwardly from the neck a greater distance than the stops and the gear cam extends radially outwardly a distance to hit only the detent. The detent has a straight flat surface as is preferred.

Figure 4:
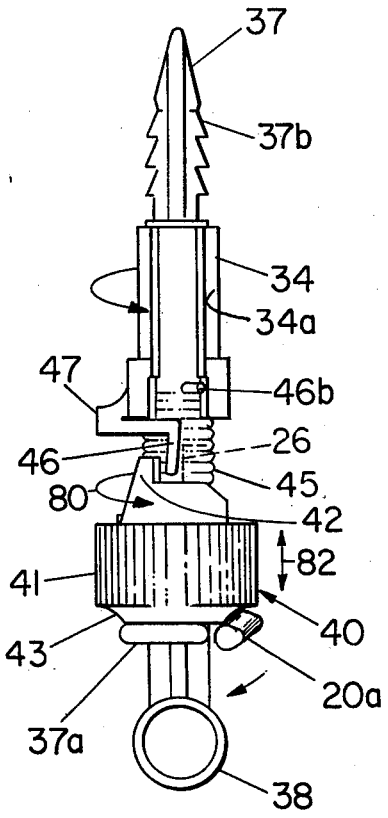
FIG. 4 is a perspective view illustrating the head rotating mechanism used in the doll of FIGS. 1, 2 and 3.
Figure 5:
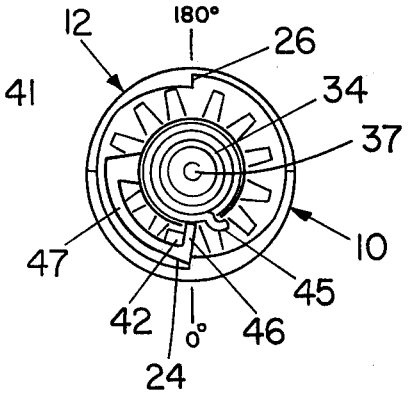
FIG. 5 is a cross-section of a detent mechanism used in the doll of FIGS. 1–3

In order to better understand the relationship between the cam gear assembly 40, shaft 37, neck sleeve assembly 34 and its detent 46, reference is now made to FIG. 5 and to FIG. 4. FIG. 5 shows a cross-section of the neck portion formed by the torso portions 10 and 12 having therein the integrally formed stops 24 and 26. The stops are seen to present a flat surface extending out from the suface of the neck and are located approximately 180° apart. The neck sleeve 34 mounted about shaft 37 and connected with torsion spring 45, is seen to carry the detent 46 by means of the laterally flexible strip 47. Suitably, neck sleeve 34 is formed of plastic material of the desired structural characteristic. The detent 46 has a flat surface abutting the stop 24. The underlying protruding cam portion 42 forming a part of the cam gear assembly 40 described in connection with FIG. 2 is partially illustrated in FIG. 5. It is simply noted that with detent 46 moved up above the stop 24 the spring drives the neck sleeve 34 around the shaft axis 37 and detent 46 strikes stop 26 to prevent the neck sleeve from rotating further until detent 46 is subsequently again disengaged.

Reference is made to FIG. 4 which shows the aforedescribed elements in a front perspective view. Thus, the assembly in FIG. 4 is as viewed from the front of the figurine in FIG. 2. Thus shaft 37 is seen to extend down to the eyelet or mounting opening 38 previously described and carries a stop **37*a* for preventing the gear assembly 40 from sliding along the shaft to a lower position. As is disclosed, the gear assembly 40 includes the gear teeth 41, the surface portion 43 and the axially protruding cam portion 42. As was previously described, the gear assembly is mounted for both rotation about shaft 37 as indicated by an arrow 80, and for reciprocation along shaft 37 as indicated by an arrow 82. The shaft includes teeth 38 previously described. The neck sleeve assembly 34 includes a main body portion containing the axially extending groove 34*a* within which to receive the projecting rim edge or axially extending ridge 33*a* on the mounted head so to properly orient and couple the head for rotation. The torsion spring 45 has the end 46*a*, as shown in FIG. 2, which is hooked into the cam gear assembly 40 at one end and is hooked into the neck sleeve sleeve at end 46*b*. The neck assembly 34 includes the axially flexible strip 47 carrying the detent 46. For purposes of illustration, the stop member 26 is illustrated by the dash lines. Also for purposes of illustration, the ramp surface 20*a* of mechanical pushbutton 18 described in FIG. 2 is shown abutting the surface portion or cam surface 41*a*. It may be noted briefly at this point that the forward movement of ramp 20*a* forces gear assembly 40 along shaft 37 toward the upper end. In so doing, projecting cam 42 engages and forces upward the flexible strip 47 carried by the sleeve assembly 34 to a position above the stop 26 which allows the torsion spring 45 by its connection 46*b* to effect a quick 180° turn for neck sleeve 34**.

As is further illustrated in FIG. 3 there is shown generally the appendages 5, 2 partially illustrated carried by the torso 1 as well as the head assembly 6 containing the face 33 as viewed from the front of the figure. Other than to note that arm 2 is rotatably mounted in a conventional manner in the figure by shaft 63 and brackets 61 as is illustrated in outline as are the legs, these items need not be further described or discussed and the reader's attention may be directed solely to the elements comprising the improved structure of the invention. There is also shown in this figure the mechanical pushbutton 18 pivotally mounted on axis 22 and carrying projecting arms 19 joined by a web 17 engaging the elastic thong member 39, partially illustrated, and carrying the lever portion 20 which is shown with its ramp surface **20*a* up in engagement with the cam surface of the gear assembly 40. A ratchet wheel or gear 50, pawl 52, and supports 53 previously partially illustrated and described in connection with FIG. 1** are also disclosed.

The ratchet wheel 50 is part of a gear assembly including a set of teeth **50*b* which engage the teeth 41 of cam gear assembly 40, as is illustrated in section. The gear assembly includes a journal portion 50*c* so that the gear assembly is rotatably mounted to the torso by means of support brackets 62 and 64. A shaft 66 extends through the gear and contains an anchor portion 68 for anchoring the arm in the doll assembly. Shaft 66 is rotationally coupled by means of extensions 71 to a ratchet member 73 which is seen to have a somewhat hollow cylindrical geometry. Ratchet member 73 has teeth, like the one shown at 73*a*, about an outer peripheral surface for matingly engaging the ratchet teeth, like the one shown at 50*d*, of the ratchet gear 50, for permitting driving rotation of gear 50 only in the clockwise direction, as seen when looking in from the left in FIG. 3. A helical spring 72 is mounted within the hollow of the ratchet member 73. Suitably, ratchet member 73 is moveable along shaft 66. It is apparent that the surface 50*c* is wider than the support bracket 62 and 64** so as to allow some lateral play to exist for the gear assembly.

Figure 6:
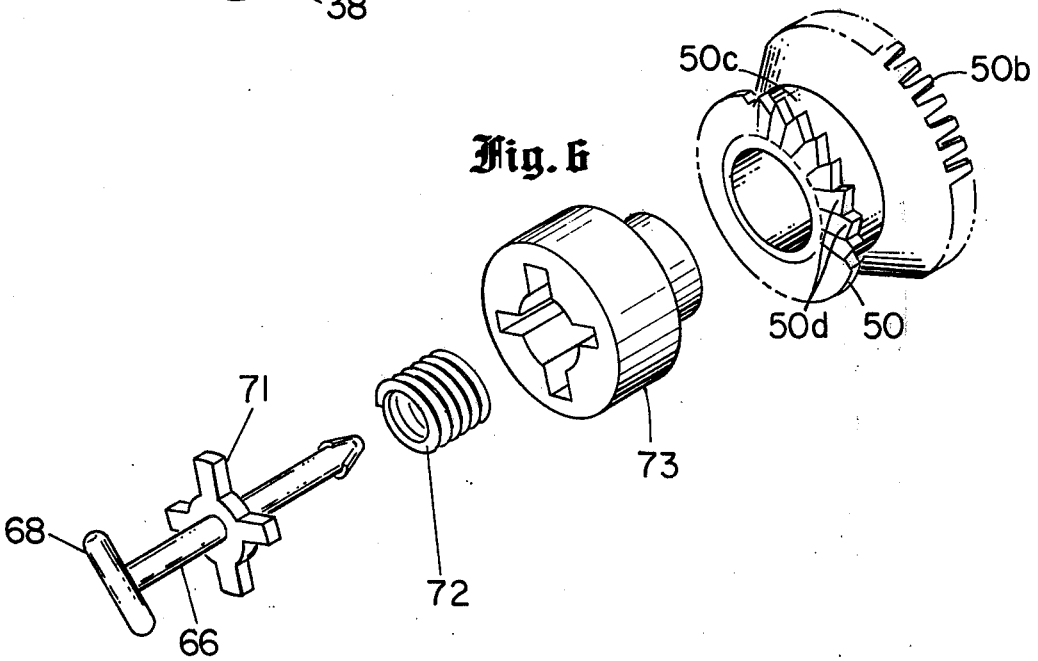
FIG. 6 is an exploded perspective view of the arm responsive mechanism illustrated in the section views of FIGS. 2 and 3.

An explanation at this point should be helpful. The ratchet member 73 forms a windup mechanism for the assembly previously described in connection with FIG. 2 and FIG. 4 and includes a simple clutch arrangement formed by the ratchet member 73 and spring 72. Thus for example, as was previously explained, gear 40 rotates about its axis until a detent position is reached. However if the user continues to bear rotational pressure on the doll's arm 5 continuing to torque shaft 66, the ratchet 73 is forced to move axially to the left along shaft 66 against the force of spring 72 and jump or disengage its teeth from those of ratchet 50 and jump to the next ratchet position. When the member 73 is so disengaged and is forced to the left in the figure, it so moves compressing spring 72. The continued torque on shaft 66 rotates ratchet 73 sufficiently to cause the teeth to overlie the meshing teeth in ratchet 50 and spring 72 forces the ratchet to move axially to the right along shaft 66 back into engagement with ratchet 50. For the reader's information, the elements of this winding and clutching mechanism are shown in an exploded view in FIG. 6.

Figure 7B:
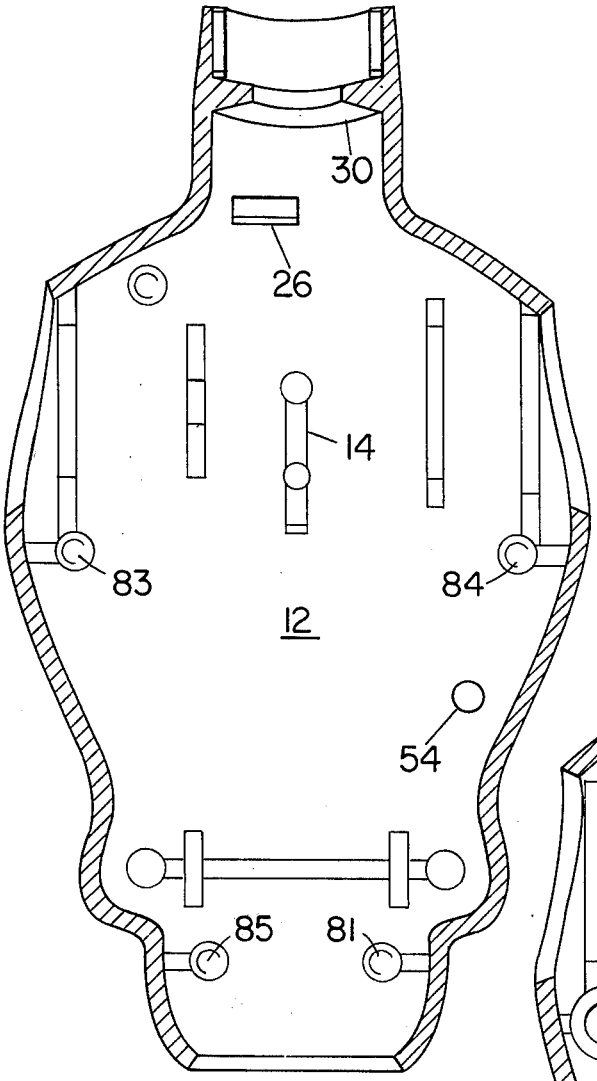
FIGS. 7*a* and 7*b* illustrate the opposite halves of the torso portion and pushbutton used in the preferred embodiment.
Figure 7A:
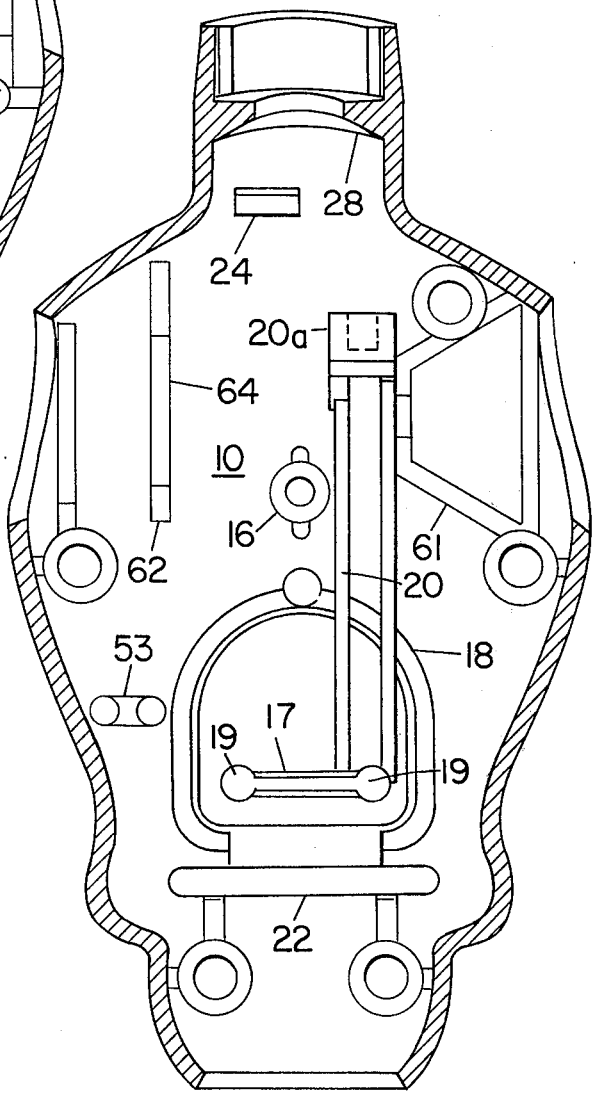

In order to assure that the reader understands the nature of the construction of the doll there is included in FIGS. 7*a* and 7*b* respective views of the back torso portion 10 and front torso portion 12 oriented so as to disclose the various internal brackets and support structure described in connection with the preceding figures. Thus there is disclosed the stop members 24 and 26, the annular inwardly projecting end portion of the neck portion 28, the support 53 and 54, the shaft support assembly 16 and 14, the support and the lever mechanism 18, 19 and 20. The gear assembly support 64 and 62 and various pins 81, 85, 83 and 84 for joining together the halves of the body through the use of suitable cement or plastic adhesives. It is noted that all of the elements are suitably made of plastic materials having sufficient strength and structural characteristics in the doll.

Reference is again made to FIGS. 2, 3, 4 and 5 in connection with a description of the operation of the doll. Considering the view shown in FIG. 3, the user raises the doll's arm forwardly to an upward position. In so doing, the ratchet 73, a conventional coupling device for coupling rotational movement in one direction only, disengages from the corresponding ratchet of ratchet-gear assembly 50 and shaft 66 and ratchet 73 rotates counterclockwise. The arm is then rotated downwardly or clockwise, the shaft 66 and ratchet 73 rotates; the ratchet engages the ratchet gear assembly 50 and similarly rotates those members. The gear teeth 50*b* engage gear teeth 41 in the cam gear assembly and rotates cam gear assembly 40 clockwise. Gear assembly 40 rotates under the driving torque to a position, illustrated by FIG. 4, in which its protruding cam 42 is positioned by and encounters releasible detent 46 forms a barrier in the path of movement of protruding cam 42. Typically the rotation in one-half revolution or 180° about shaft 37. The gear assembly 40 in so doing rotates or winds the spring end 46*a* approximately 180° about shaft 37 to increase torsional force in spring 45. At that point the child has adequately "wound up" or cocked the mechanism and, preferably, should not further rotate the arm.

Typically, the doll's arm is rotated clockwise by 180° at most in the forgoing mode of operation. Should the child force the doll's arm to rotate clockwise further, the ratchet 73 disengages from the ratchet gear assembly 50 through the clutchlike action previously described.

Once the user releases the doll's arm, the stop pawl 52, shown in engagement with ratchet 50 in FIG. 2, prevents gear 40 from rotating counterclockwise under the contra-rotational force exerted by torsion spring 45.

Referring to FIG. 4, the clockwise revolution of the cam gear to the position shown has wound up or increased the torsion force in torsion spring 45, which in the normal condition was prebiased with some tension. As a result, the spring exerts a rotational force at end 46*b* applied upon the neck sleeve assembly 34 urging the neck sleeve into rotation. However, because the detent 46 is in abutment with the stop 26, as indicated by the broken lines in FIG. 4 and as shown in the cross-section of FIG. 2, the neck sleeve assembly 34 cannot rotate. The user then triggers or actuates the head rotating action by depressing the pivotally mounted mechanical pushbutton 18. In so doing, the attached lever is pivoted about axis 22 and the upper wedge or ramp portion 20*a* as clearly shown in FIG. 2 and as represented in FIG. 4, pushes against the camlike surface 43 underlying and forming an integral side surface of the gear assembly 40. The forward movement of the ramp pushes the gear along the axis of shaft 37, compressing the torsion spring, until the protruding cam engages the flexible strip 47 supporting the detent 46. Following through with further movement, the protruding cam 42 pushes strip 47 upwardly which in turn pushes the detent 46 off of stop 26 and thereby releases the detent. The restraining force upon spring 45 is removed and the torsion spring rotates the neck sleeve 34 to instantaneously revolve the sleeve 34 clockwise through 180° until the carried detent 46 abuts the stop at the oppostie side of the model, such as illustrated at stop 24 in FIG. 2. During the rotation of sleeve member 34, the inherent flexure of the strip 47 moves the detent axially downward toward the cam gear assemmbly to restore the detent to its position in the path of the stop means.

As previously was described, the head is coupled to the sleeve 34 by an inwardly protruding axially extending ridge 33*a* engaged in a groove 34*a* in the neck sleeve 34 for joint rotation of the elements. The head thus revolves by one-half revolution so that face 33 is concealed under the simulated wig 35 and face 32 is now exposed to view at the front of the model.

The foregoing action may then be repeated. As is shown in FIG. 5 when the doll's arm is rotated forwardly and downwardly from a raised position or clockwise, the gear assembly 40 is rotated counterclockwise, approximately one-half revolution, increasing torsion in spring 45 and aligning the coupled protruding cam member 42 into a position to disengage the releasible detent 46 carried by the neck assembly, thereby cocking the head rotating means for operation and preparing same so that the actuating means may thereafter release the detent and permit one-half revolution of the doll's head in the manner described.

Viewing FIG. 5 it is seen that detent 46 moves from stop 24 to abutment with stop 26. Upon further actuation the detent is moved off of stop 26 and the sleeve assembly revolves until the detent again comes into contact with stop 24. The foregoing is repeated each time the user rotates the arm 5 to further load or torque the spring mechanism and then depresses pushbutton actuator switch 18 to trigger rotational movement of one-half revolution of the sleeve 34 and head 31.

It is noted that the web 17 between arms 19 abutts the thong member 39*b* 39 and the stop member located on there. By pivoting or pushing on pushbutton 18 a force is exerted on the flexible member to further stretch it. Thus when the finger is removed from the push member the resilient force in the elastic member assists to pivot the mechanical member back to its normal position with the face flush with the back torso portion.

The foregoing thus discloses a preferred embodiment describing how to make and use the invention in both its broad and indeed in its more specific aspects. The purpose of providing an animated doll having a change of face with a simple method of energizing it, namely manipulation of an arm or any other selected appendage, and by mechanically triggering it through operating a pushbutton at the other end, or any other mechanical arrangement, has been described. Clearly modifications may be made if desired which contain either the broad or the more specific aspects of the invention and still come within the scope of the foregoing.

It is believed that the preferred embodiment of the invention is described in such detail as to enable one skilled in the art to make and use same. However, it is not intended for the invention to be limited to those details presented for the foregoing purpose inasmuch as various modifications or improvements or substitution of equivalents for those details apparent to one skilled in the art upon reading this specification, all of which embody the principles of the invention. Accordingly, it is respectfully requested that the invention be broadly construed within the full spirit and scope of the appended claims.

What is claimed is:

1. In a toy figurine the combination comprising:
a simulated head, said head containing two faces located on opposite sides thereof and an axial passage therethrough;
a torso, said torso having an upwardly extending neck portion;
an arm movably mounted on said torso;
a shaft fixedly connected within said torso and extending out said neck portion;
a sleeve member rotatably mounted on said shaft;
means coupling said head to said sleeve member for joint rotation with said sleeve member with said axial passage in said head and said sleeve member being coaxially positioned,
said shaft having an upper end extending through said passage in said head to a position above said head;
concealing means mounted to said shaft about said upper end thereof for concealing one of said faces from view;
gear means having an axis of rotation,
said gear means being mounted on said shaft for rotation about said shaft and for reciprocal movement along the axis of said shaft;
a protruding cam member coupled to said gear means for joint movement therewith and protruding axially in the direction of said sleeve member and located off the axis of said gear means;
a torsion spring mounted about said shaft in between said sleeve member and said gear means,
said torsion spring having one end coupled to said sleeve member and the other end coupled to said gear means for urging said sleeve member and said gear means in relative contra-rotation;
a pair of stop means affixed to said torso,
said stop means being located at diametrical opposed positions adjacent said shaft for providing barriers;
detent means,
said detent means being supported and carried by said sleeve member by a flexible strip connecting them for rotational movement together but allowing relative axial movement therebetween
each of said stop means being located in the rotational path of travel of said detent means for preventing rotation of said sleeve number relative to said torso during engagement with said detent means;
said detent means being located in the rotational path of said protruding cam member for stopping said protruding cam member and said gear means from rotation relative to said sleeve member during engagement with said detent means;
coupling means responsive to rotational movement of said arm for drivingly rotating said gear means in a first direction until said protruding cam member engages said detent means and said detent means engages a said stop means to increase torsion in said torsion spring and to locate said protruding cam member by said detent means;
actuating means for pushing said gear means axially along said shaft in the direction of said sleeve member for forcing said protruding cam member against said flexible strip to axially move said detent means off of said one of said stop means;
whereby said torsion spring rotatably drives said sleeve member and the head carried thereby through one-half revolution to a position in which said detent means engages the next stop means.

2. The invention as defined in claim 1 wherein said coupling means comprises:
a hollow cylindrical-like member having an axis of rotation and ratchet means on an outer surface;
a second shaft;
means coupling said second shaft and said hollow cylindrical-like member for joint rotational movement and for relative axial movement;
second means coupling one end of said second shaft to said arm for rotating said second shaft responsive to rotation of said arm;
ratchet and gear means located in said torso for coupling rotational movement of said hollow cylindrical-like member to said gear means, including a rotatably mounted ratchet;
spring means located within the hollow of said cylindrical-like member for biasing said cylindrical-like member in an axial direction away from said one end of said second shaft for bringing said ratchet means into engagement with said rotatably mounted ratchet on said ratchet and gear means;
and blocking means associated with said ratchet and gear means for preventing motion in an opposite rotational direction.

3. The invention as defined in claim 2 wherein said blocking means comprises:
a second ratchet means carried by said ratchet and gear means; and
a pawl mounted to said torso for engaging said second ratchet means and preventing motion thereof in an opposite rotational direction.

4. The invention as defined in claim 1 wherein said actuating means comprises:
a pushbutton located in the rear of said torso and pivotally mounted in said torso;
a lever arm carried by said pushbutton having a ramp end surface;
said ramp end surface engaging an underlying side surface of said gear means, and responsive to pivoting of said pushbutton for axially moving said gear means.

5. The invention as defined in claim 3 wherein said actuating means comprises:
a pushbutton located in the rear of said torso and pivotally mounted in said torso;
a lever arm carried by said pushbutton having a ramp end surface;
said ramp end surface engaging an underlying surface of said gear means, and responsive to pivoting of said pushbutton for axially moving said gear means.

6. The invention as defined in claim 1 wherein each said stop means includes:
a flat surface extending toward and extending parallel to the axis of said shaft for abutment with said detent means, and wherein said detent means includes two opposed flat surfaces for engaging said stop means and for engaging said protruding cam member, respectively, and wherein said protruding cam member incudes a flat surface extending parallel to said shaft axis for engaging said detent means.

7. In a toy figurine of the type containing a torso, a rotatably mounted external appendage thereon, a rotatably mounted head thereon having two faces located on opposite sides of said head and a member fixedly coupled to the torso thereof for concealing one of said faces, the combination therewith comprising:

spring driven means including a torsion spring located within said torso for rotating said head relative to said torso by 180° between first and second detent positions, holding means for releasably holding said spring-driven means in a selected one of said detent positions;

cocking means coupled to said appendage of said figurine for increasing torsional force in said spring responsive to rotating said appendage a predetermined distance and for preparing said spring driven means for release from said one detent position; and means responsive to sequential operation of said cocking means and to a pushbutton at the rear of said figurine torso for causing said holding means to release said spring driven measn from said one detent position to permit said spring driven means to turn said head substantially instantaneously by 180°.

8. The invention as defined in claim 7 wherein said spring driven means comprises:

a shaft extending through said torso and fixed in position;

a sleeve member rotatably mounted on said shaft and carrying a movable detent;

a torsion spring mounted about said shaft having one end coupled to said sleeve member; and a pair of stop means in said torso located diametrically opposite one another about said shaft and in the path of movement of said detent means.

9. The invention as defined in claim 8 wherein said cocking means comprises:

gear means rotatably and reciprocally mounted to said shaft;

a protruding cam member carried by said gear means extending from a side surface thereof off the axis thereof in a direction toward said sleeve member;

said protruding cam member having a path of movement for abutting said detent and being reciprocally movable in said abutting position for moving said detent off of a said stop means.

10. The invention as defined in claim 9 wherein said responsive means comprises:

cam means responsive to pivotal movement of said pushbutton member for sliding said gear means along said shaft toward said sleeve member;

whereby said protruding cam member carried by said gear means moves said detent off of a said stop means to permit said spring driven means to rotate said head.

11. The invention as defined in claim 9 wherein said cocking means further includes clutch means coupled between said appendage and said gear means for decoupling rotational torque from said gear means when said protruding cam member is in abutting engagement with said detent irrespective of further rotation of said appendage

12. The invention as defined in claim 9 wherein said cocking means further includes:

reverse rotation inhibiting means for preventing contra-rotation of said gear means; and clutch means coupled between said appendage and said gear means for decoupling rotational torque above a predetermined level from said gear means.

13. The invention as defined in claim 12 wherein said inhibiting means includes a ratchet coupled for rotation with said gear means and a stop pawl located in said torso engaging said ratchet.

14. In a toy figurine of the type having a torso, an arm rotatably mounted in said torso, and a head containing two different faces, said faces located on opposite sides of said head, the improvement comprising in combination:

a. head rotating means located in said torso and coupled to said head for rotating said head about its axis between first and second detent positions relative to said torso, said head rotating means including: a shaft; a rotatably mounted sleeve member mounted for rotation on said shaft; a torsion spring mounted on said shaft and connected at one end to said sleeve member; a releasable detent coupled to said sleeve member for rotation therewith and means on said torso for stopping said sleeve member at each said detent position;

b. cocking means in said figurine responsive to a predetermined rotation of said figurine arm for preparing said head rotating means for release from a said detent position and for increasing torsion in said torsion spring, said cocking means including:

a rotatable means;

a movably positionable detent releasing means operable to release said detent of said head rotating means from said stopping means only when positioned adjacent said detent; and means for rotating said rotatable means approximately one-half revolution to rotate said spring end approximately one-half revolution about said shaft and, concurrently, to move said detent releasing means to said position adjacent said detent; and c. actuating means for operating said detent releasing means of said cocking means responsive to operation of a pushbutton means located on said torso.

15. The invention as defined in claim 14 wherein said rotatable means comprises: gear means rotatably and slidably mounted on said shaft;

and wherein said positionable detent releasing means comprises: a protruding cam member coupled to and carried by a side surface of said gear means at an off-axis position therealong and extending axially a predetermined distance in the direction of said sleeve member.

16. The invention as defined in claim 15 wherein said means for rotating said rotatable means included in said cocking means comprises further:

a ratchet and gear assembly, rotatably mounted in said torso having its gear engaging said gear means;

a shaft coupled at one end to said figurine arm, a rotatable member slidably coupled to said shaft for rotation therewith, said rotatable member having a ratchet for driving said ratchet and gear assembly in one rotational direction;

spring means located about said shaft for biasing said rotatable member into engagement with said ratchet and gear assembly.

17. The invention as defined in claim 15 wherein said actuating means comprises:

a pushbutton member accessible at the rear of said torso and pivotally mounted to said torso;

an arm carried by said pushbutton member havin a ramplike end surface for engagement with a side surface of said gear means to axially slide said gear means responsive to pivoting of said pushbutton member.

* * * * *